US006508156B1

(12) United States Patent
Wei

(10) Patent No.: US 6,508,156 B1
(45) Date of Patent: Jan. 21, 2003

(54) SCREWDRIVER TOOL BOX STRUCTURE

(76) Inventor: Yong Lung Wei, No. 1, Alley 16, Lane 40, Jinn Te Rd., Taichung (TW)

( * ) Notice: Subject to any disclaimer, the term of this patent is extended or adjusted under 35 U.S.C. 154(b) by 0 days.

(21) Appl. No.: 09/961,547

(22) Filed: Sep. 24, 2001

(51) Int. Cl.[7] ..... B25G 1/08
(52) U.S. Cl. ..... 87/490; 87/177.4
(58) Field of Search ..... 87/177.4, 490

(56) References Cited

U.S. PATENT DOCUMENTS 5,566,596 A * 10/1996 Lin ..... 81/177.4
5,613,413 A * 3/1997 Huang ..... 81/177.4
5,875,692 A * 3/1999 Lin ..... 81/490
5,899,127 A * 5/1999 Shiao ..... 81/177.4
5,957,014 A * 9/1999 Tseng et al. ..... 81/490
6,186,036 B1 * 2/2001 Huang ..... 81/177.4
6,237,451 B1 * 5/2001 Wei ..... 81/177.4
6,305,256 B1 * 10/2001 Anderson et al. ..... 81/177.4
6,334,743 B1 * 1/2002 Liao ..... 81/490

* cited by examiner

*Primary Examiner*—James G. Smith

(57) ABSTRACT

A screwdriver tool box structure includes a receiving body, two transparent covers, and a cover body mounted on one transparent cover. The cover body has an outer periphery provided with a flange face, for increasing friction during use and operation. A seat is mounted in the cover body, and an insertion recess is formed in the seat for allowing insertion of a first driver head, so that the cover body may function as a screwdriver. The seat has receiving recesses, for receiving multiple second driver heads, and a plurality of holes formed in the cover body are communicated with the receiving recesses, so that a user may see through the holes if the second driver are contained in the receiving recesses.

1 Claim, 7 Drawing Sheets

SCREWDRIVER TOOL BOX STRUCTURE

BACKGROUND OF THE INVENTION

1. Field of the Invention

The present invention relates to a screwdriver tool box structure, and more particularly to a screwdriver tool box structure which may be assembled conveniently and operated easily.

2. Description of the Related Art

The closest prior art of which the applicant is aware is disclosed in the applicant's Taiwanese Utility Patent No. 165658, entitled by "Screwdriver Tool Box Structure". As shown in FIG. 1, the screwdriver tool box structure in accordance with the above-mentioned utility patent comprises a receiving body 10, and two transparent covers 20 each mounted on the front end and the rear end of the receiving body 10. However, when the user's one hand holds and rotates the front transparent cover 20, the rear transparent cover 20 will idle, and the driver heads contained in the rear transparent cover 20 will fall out, thereby causing inconvenience to the user.

SUMMARY OF THE INVENTION

The present invention has arisen to mitigate and/or obviate the disadvantage of the conventional screwdriver tool box structure.

The primary objective of the present invention is to provide a screwdriver tool box structure which may be assembled conveniently and operated easily.

In accordance with the present invention, there is provided a screwdriver tool box structure, comprising: a receiving body, two transparent covers each mounted on a front end and a rear end of the receiving body, and a cover body mounted on one of the two transparent covers, wherein the cover body has a semi-shade shape, and has an outer periphery provided with a flange face, for increasing friction during use and operation, a seat is mounted in a central portion of an inner wall of the cover body, an insertion recess is formed in a central portion of the seat for allowing insertion of a first driver head which is partially inserted into the one transparent cover, thereby connecting the cover body with the one transparent cover, the first driver head may be inserted into the insertion recess of the cover body, so that the cover body may function as a screwdriver, the seat has a periphery provided with a plurality of receiving recesses, for receiving multiple second driver heads of different kinds, a plurality of holes are formed in an outer periphery of the cover body and are communicated with the receiving recesses, so that a user may see through the holes if the second driver heads of different kinds are contained in the receiving recesses, and each of the holes has a size smaller than that of the respective receiving recess, thereby preventing the driver heads from being detached from the holes.

Further benefits and advantages of the present invention will become apparent after a careful reading of the detailed description with appropriate reference to the accompanying drawings.

DETAILED DESCRIPTION OF THE INVENTION

Figure 1:
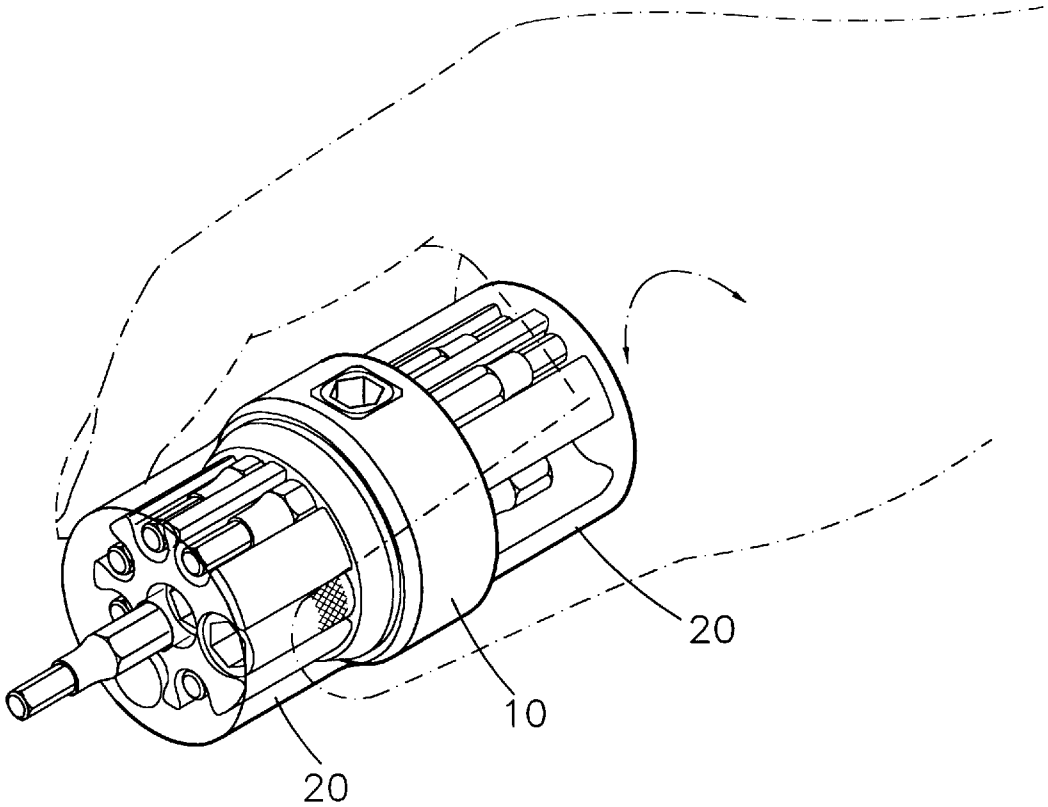
FIG. 1 PRIOR ART
FIG. 1 is a perspective view of a conventional screwdriver tool box structure in accordance with the prior art.
Figure 2:
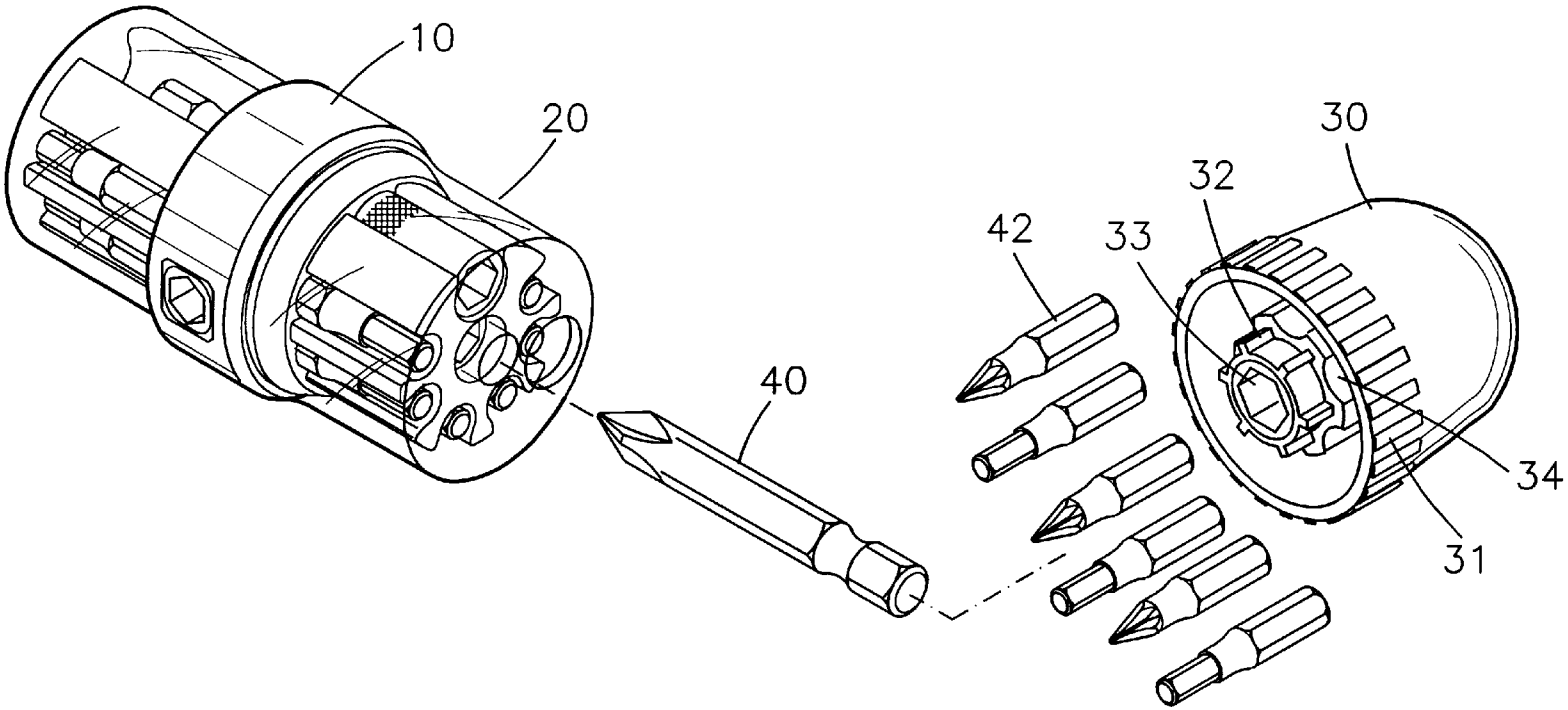
FIG. 2 is an exploded perspective view of a screwdriver tool box structure in accordance with a preferred embodiment of the present invention.
Figure 3:
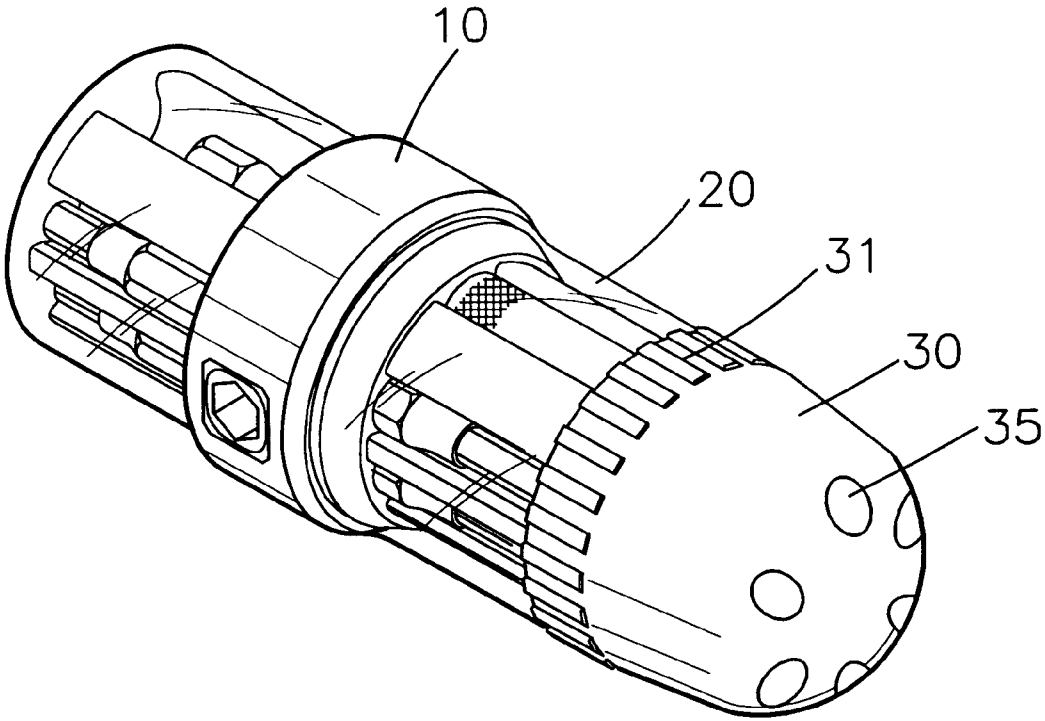
FIG. 3 is a perspective assembly view of the screwdriver tool box structure as shown in FIG. 2.
Figure 4:
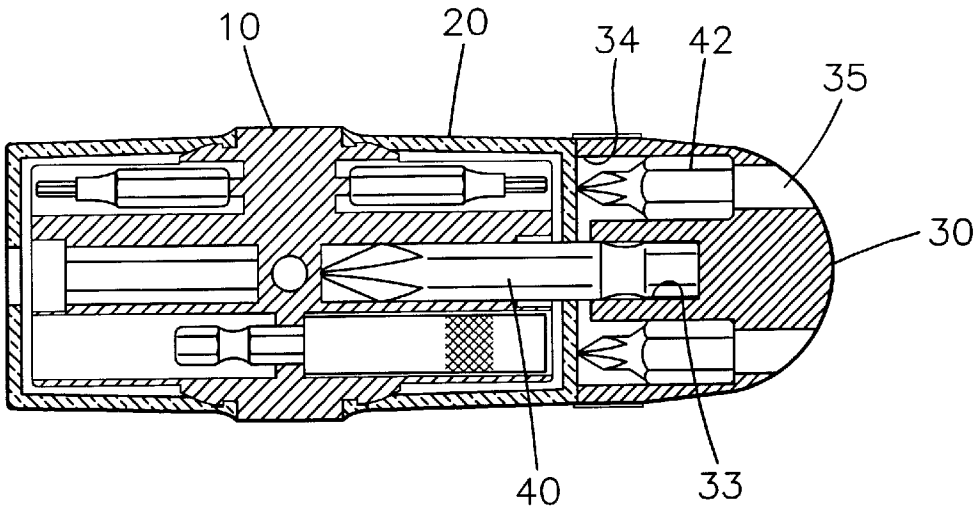
FIG. 4 is a side plan cross-sectional assembly view of the screwdriver tool box structure as shown in FIG. 2.
Figure 5:
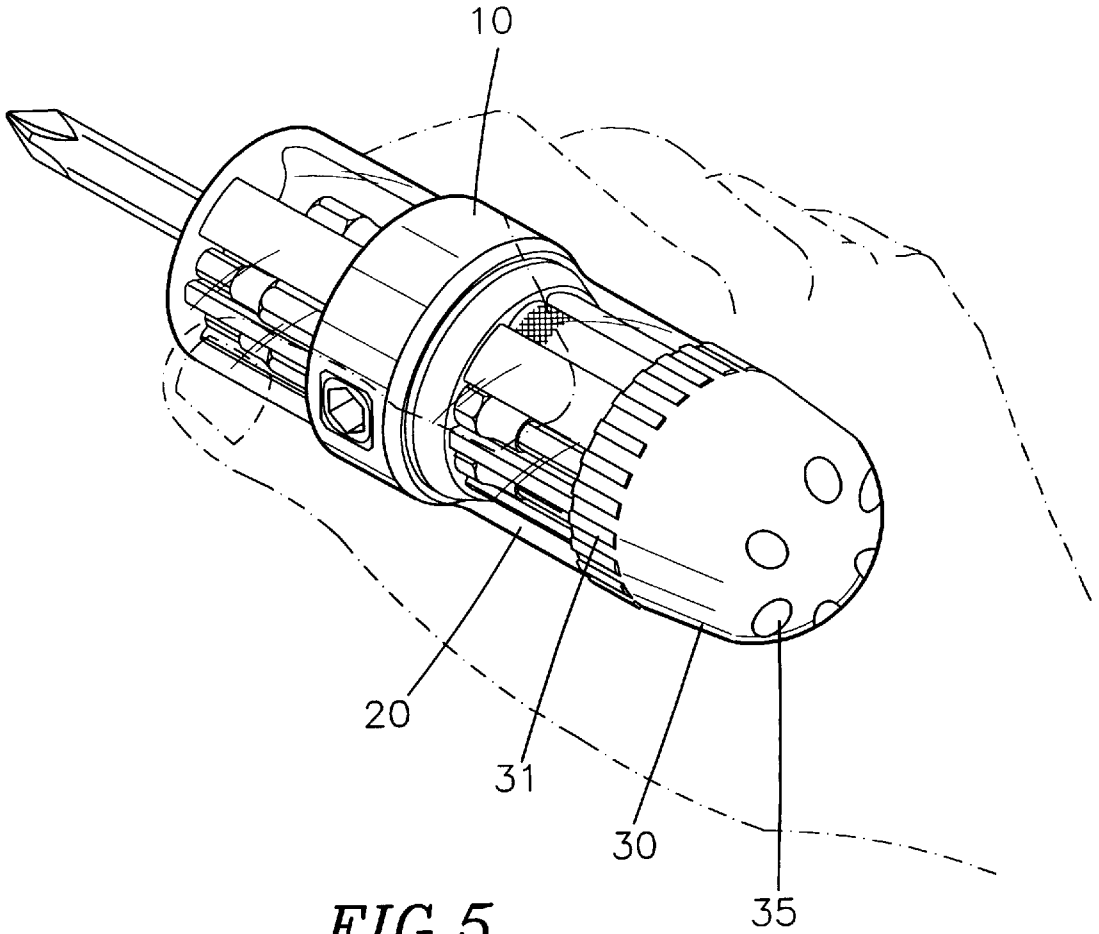
FIG. 5 is a schematic operational view of the screwdriver tool box structure as shown in FIG. 3 in use.

Referring to the drawings and initially to FIGS. 2–4, a screwdriver tool box structure in accordance with a preferred embodiment of the present invention comprises a receiving body 10, and two transparent covers 20 each mounted on the front end and the rear end of the receiving body 10, and a cover body 30 mounted on the rear transparent cover 20.

The cover body 30 has a semi-shade shape, and has an outer periphery provided with a flange face 31, for increasing the friction during use and operation. A seat 32 is mounted in a central portion of an inner wall of the cover body 20, and an insertion recess 33 is formed in a central portion of the seat 32 for allowing insertion of a driver head 40 having a greater length. The driver head 40 may be inserted into the rear transparent cover 20, thereby connecting the cover body 30 with the rear transparent cover 20. The driver head 40 may be inserted into the insertion recess 33 of the cover body 30, so that the cover body 30 may function as a screwdriver.

The seat 32 has a periphery provided with a plurality of receiving recesses 34, for receiving multiple driver heads 42. A plurality of holes 35 are formed in an outer periphery of the cover body 30 and are communicated with the receiving recesses 34, so that the user may see through the holes 35 if the driver heads 42 are contained in the receiving recesses 34. The holes 35 may also enhance the aesthetic quality of the cover body 30. The size of each of the holes 35 is smaller than that of each of the respective receiving recesses 34, thereby preventing the driver heads 42 from being detached from the holes 35.

In assembly, referring to FIGS. 2–4, each structure of the receiving body 10 is formed integrally, and is covered by the front and rear transparent covers 20. The cover body 30 of the present invention is also formed integrally. That is, the flange face 31, the seat 32, the insertion recess 33, the receiving recesses 34, and the holes 35 are formed integrally, so that fabrication of the screwdriver tool box structure in accordance with the present invention is very easy, thereby increasing the productivity.

In operation, referring to FIGS. 5–8, the user's one hand may hold the outer face of the cover body 30, and the flange face 31 may provide more powerful force applying points, so that when the receiving body 10 and the covers 20 are rotated, it will not cause the idle operation phenomenon.

Figure 6:
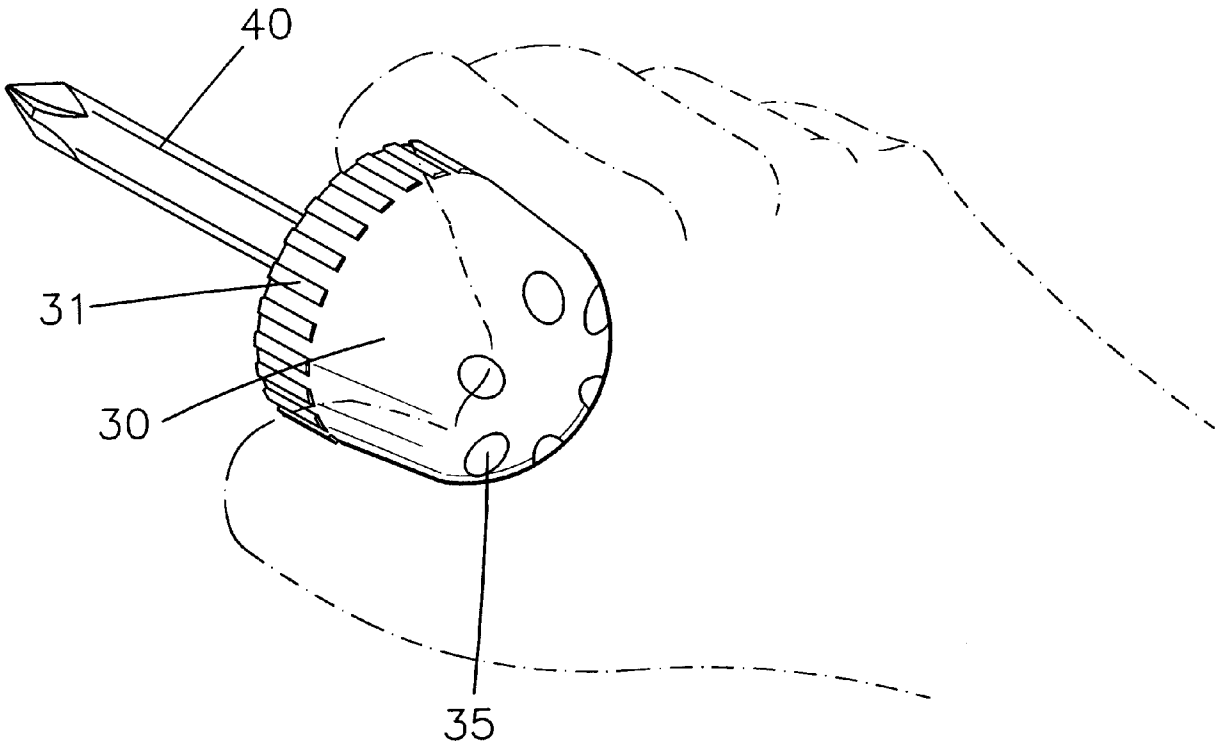
FIG. 6 is a schematic operational view of the screwdriver tool box structure as shown in FIG. 3 in use.
Figure 7:
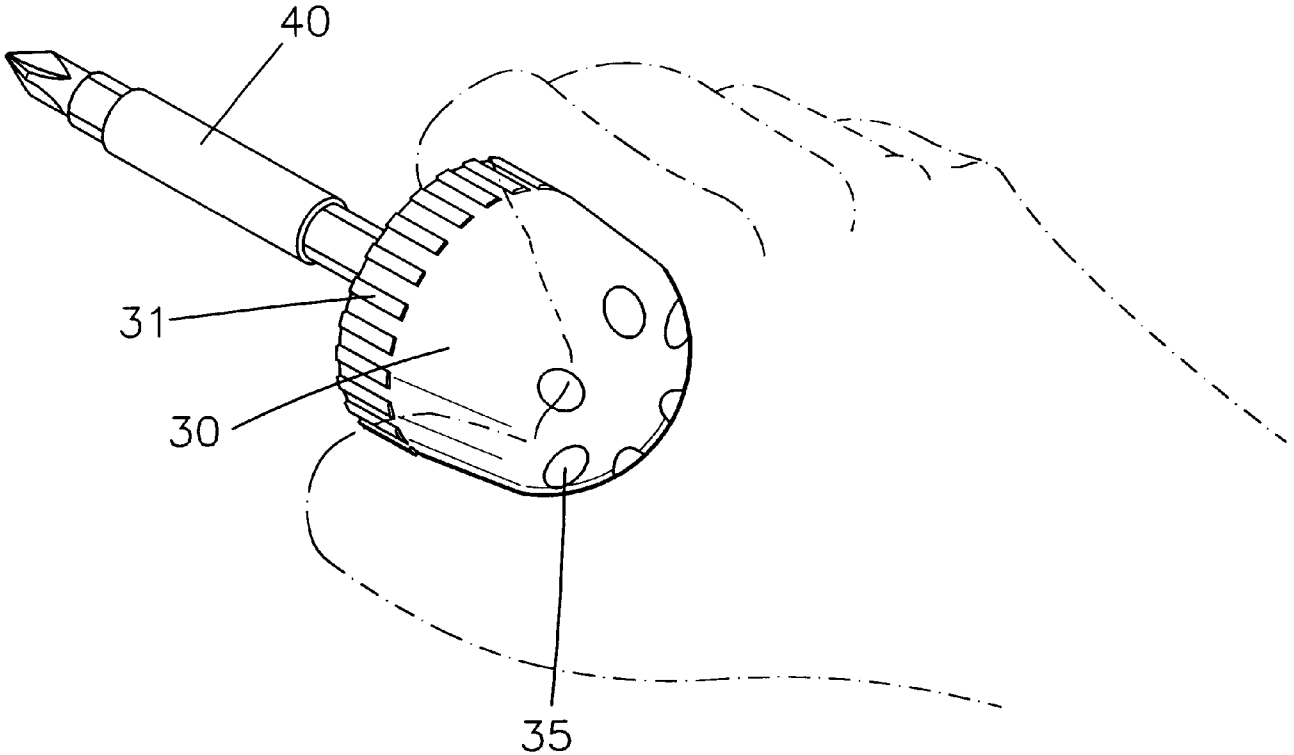
FIG. 7 is a schematic operational view of the screwdriver tool box structure as shown in FIG. 3 in use.

In addition, the cover body 30 may co-operate with the driver head 40 to function as a screwdriver individually as shown in FIGS. 6 and 7, so that the screwdriver may be used in a narrow space or used at the corner.

Figure 8:
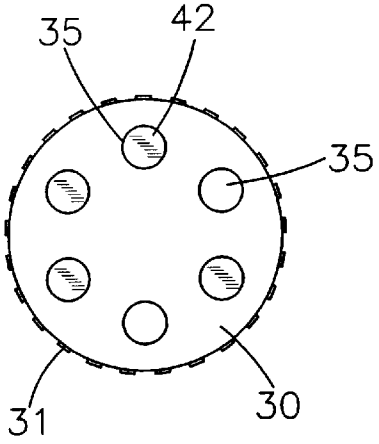
FIG. 8 is a plan view of the screwdriver tool box structure as shown in FIG. 3.

Further, the user may see through the holes 35 of the cover body 30 if the driver heads 42 are contained in the receiving recesses 34 as shown in FIG. 8, thereby facilitating the user taking the driver heads 42.

Accordingly, the screwdriver tool box structure in accordance with the present invention has the following advantages.

1. The screwdriver tool box structure may receive more kinds of driver heads, thereby providing more usage functions and choices.
2. The screwdriver tool box structure may have a rigid support point with operation of a greater torque, thereby improving the phenomenon of idle operation.
3. The cover body of the screwdriver tool box structure may be used individually, thereby greatly enhancing the versatility of the screwdriver tool box structure.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A screwdriver tool box structure, comprising: a receiving body, two transparent covers each mounted on a front end and a rear end of the receiving body, and a cover body mounted on one of the two transparent covers, wherein the cover body has a semi-shade shape, and has an outer periphery provided with a flange face, for increasing friction during use and operation, a seat is mounted in a central portion of an inner wall of the cover body, an insertion recess is formed in a central portion of the seat for allowing insertion of a first driver head which is partially inserted into the one transparent cover, thereby connecting the cover body with the one transparent cover, the first driver head may be inserted into the insertion recess of the cover body, so that the cover body may function as a screwdriver, the seat has a periphery provided with a plurality of receiving recesses, for receiving multiple second driver heads of different kinds, a plurality of holes are formed in an outer periphery of the cover body and are communicated with the receiving recesses, so that a user may see through the holes if the second driver heads of different kinds are contained in the receiving recesses, and each of the holes has a size smaller than that of the respective receiving recess, thereby preventing the driver heads from being detached from the holes.

* * * * *